US005215394A

United States Patent [19]

Kim

[11] Patent Number: 5,215,394

[45] Date of Patent: Jun. 1, 1993

[54] APPARATUS FOR DISCHARGING PRINTING PAPER IN A COLOR VIDEO PRINTER

[75] Inventor: Jae S. Kim, Kyungki-Do, Rep. of Korea

[73] Assignee: Goldstar Co., Ltd., Seoul, Rep. of Korea

[21] Appl. No.: 874,374

[22] Filed: Apr. 27, 1992

[30] Foreign Application Priority Data

Apr. 27, 1991 [KR] Rep. of Korea ..... 5868/1991

[51] Int. Cl.[5] ..... B41J 13/02

[52] U.S. Cl. ..... 400/625; 400/641; 400/636; 271/207

[58] Field of Search ..... 400/625, 636, 641, 628, 400/645; 271/207, 209, 212

[56] References Cited

U.S. PATENT DOCUMENTS 3,981,496 9/1976 Jensen et al. ..... 400/641 X
4,241,911 12/1980 Lee ..... 400/641 X

FOREIGN PATENT DOCUMENTS 0183413 6/1986 European Pat. Off. ..... 400/625
0103782 6/1984 Japan ..... 400/625

OTHER PUBLICATIONS

IBM Technical Disclosure Bulletin, vol. 30, No. 12, May 1988, "Bill Stacker For Bill-Handling Machine".
IBM Technical Disclosure Bulletin, vol. 30, No. 11, Apr. 1988, "Paper Exit Drive With Adjustable Paper Stacker".
IBM Technical Disclosure Bulletin, vol. 22, No. 6, Nov. 1979, "Paper Feed Roller And Transport".

*Primary Examiner*—Edgar S. Burr
*Assistant Examiner*—Christopher A. Bennett

[57] ABSTRACT

A printing paper discharging apparatus comprises a discharge roller, a take-out roller engaged with and driven by the discharge roller, guide members fixed on the take-out roller and provided with elastic blades for instantly pushing the trailing edge of printing paper into a paper box, thereby obtaining a complete discharging of the printing papers.

10 Claims, 5 Drawing Sheets

APPARATUS FOR DISCHARGING PRINTING PAPER IN A COLOR VIDEO PRINTER

BACKGROUND OF THE INVENTION

1. Field of the Invention

The present invention relates to an apparatus for discharging a printing paper in a color video printer which is capable of completely discharging printing papers into a paper box by providing guide members for guiding the discharge of printing papers at a take-out roller which is engaged with a discharging roller.

2. Description of the Prior Arts

In general, a color video printer is constituted such that a printing paper is fed by a pair of feed rollers along a paper passage which is defined by an upper guide and a lower guide. After passing through the paper passage, the printing paper is transferred between a pinch roller and a grip roller and then located below a donor cassette containing a film therein. When the trailing edge of the printing paper is located between the pinch roller and the grip roller, the printing paper is pressed on a platen roller together with the film from the donor cassette by a thermal print head. The printing paper which is in contact with the platen roller is inversely transferred by an inverse rotation of the grip roller and at this moment a predetermined picture image is printed on the printing paper. Then, the printing paper is discharged into a paper box by a discharge roller and a take-out roller.

A conventional color video printer with such a typical discharging path is illustrated in FIG. 1. As shown in FIG. 1, the conventional color video printer comprises a pair of feed rollers 1*a* and 1*b* on which a feed belt 1*c* is wound, a roller 2*a* rotatably mounted below the feed roller 1*a* for preventing a double feeding, a donor cassette guide 3 fixed adjacent to the roller 2*a*, an upper and a lower guides 4 and 5 for defining a passage 30, a grip roller 6 and a pinch roller 7 engaged with each other, a platen roller 8 rotatably mounted in front of the rollers 6 and 7, a thermal print head 9 pivotably mounted over the platen roller 8, a donor cassette 10 supported by donor cassette guides 3 and 3*a* between the thermal print head 9 and the platen roller 8, a take-out roller 11 and a discharge roller 12 engaged with each other and provided at the rear side of the lower guide 5, and a paper box 13 supported at the rear side of the discharge roller 12 by a support member 14.

In FIG. 1, reference numeral 5*a* denotes a printing paper guide, 13*a* a rim portion of the paper box 13, 15 a printing paper, 16 a cam, 17 a link mechanism, and 18 a film.

The color video printer as shown in FIG. 1 operates as follows.

A shown in FIGS. 1 and 2, a printing paper 15 is fed by the feed rollers 1*a* and 1*b* and passes through the paper passage 30 defined by the upper and lower guides 4 and 5. And then, the printing paper 15 is transferred between the donor cassette guide 3*a* and the printing paper guide 5*a* by the grip roller 6 and the pinch roll 7. At this moment, when the trailing edge of the printing paper 15 is located between the grip roller 6 and the pinch roller 7, the thermal print head 9 rotates toward the platen roller 8 by the operation of the cam 16 and the link mechanism 17 so that the printing paper 15 and the film 18 contained in the donor cassette 10 are pressed on the platen roller 8. In this state, the grip roller 6 transfers the printing paper 15 in the inverse direction while rotating in the inverse direction by a separate driving source and thermal print head 9 prints a predetermined picture image on the printing paper 15. And then, the printing paper 15 is discharged into the paper box 13 by a take-out roller 11 and the discharge roller 12 through the passage 30 formed between the upper and lower guides 4 and 5.

In such a conventional color video printer, the printing paper 15 is not completely discharged into the paper box 13 at times, that is a phenomenon that the trailing edge of the printing paper 15 is hung over the rim portion 13*a* of the paper box 13 occurs frequently. In that case, since the trailing edge of the printing paper is raised upwardly, the next printing paper is caught by the previous printing paper in a continuous printing operation. In such a state, the discharge roller and the take-out roller are rotated continuously so that the picture image on the printing paper may be damaged.

SUMMARY OF THE INVENTION

Accordingly, it is an object of the present invention to provide an apparatus for discharging a printing paper for use in a color video printer which is capable of completely discharging a printing paper into a paper box by pushing the trailing edge of the printing paper with elastic members fixed on a take-out roller.

Another object of the present invention is to provide an apparatus for discharging a printing paper for use in a color video printer, which comprises a discharge roller, a take-out roller engaged with and driven by the discharge roller, and guide members having elastic blades fixed on the take-out roller.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an apparatus for discharging a printing paper into a paper box for use in a color video printer which comprises a paper passage defined by upper and lower guides, a discharge roller provided at the outlet side of the paper passage, a take-out roller engaged with and driven by the discharge roller for discharging a printing paper into a paper box, and guide members fixed on the take-out roller for pushing the trailing edge of the printing paper into the paper box.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4A to 4C are views showing the discharge roller and the take-out roller according to the present invention, in which:

FIG. 4A is a view showing the take-out roller provide with fixing grooves for fixing guide members;

FIG. 4B is a view showing a state that guide members are fixed to the fixing grooves of the take-out roller; and FIG. 4C is a sectional view taken along the line I—I of FIG. 4B;

FIGS. 6A to 6C are sectional views showing the operation of the paper discharge portion of the present invention, in which:

FIG. 6A is a view showing the guide member in a state that a printing paper is engaged between the discharge roller and the take-up roller;

FIG. 6B is a view showing the guide member in a state that the trailing edge of the printing paper is laid on the rim portion of a paper box; and FIG. 6C is a view showing a state that the printing paper is inserted into the paper box by the operation of the guide member.

DESCRIPTION OF THE PREFERRED EMBODIMENTS

Figure 1:
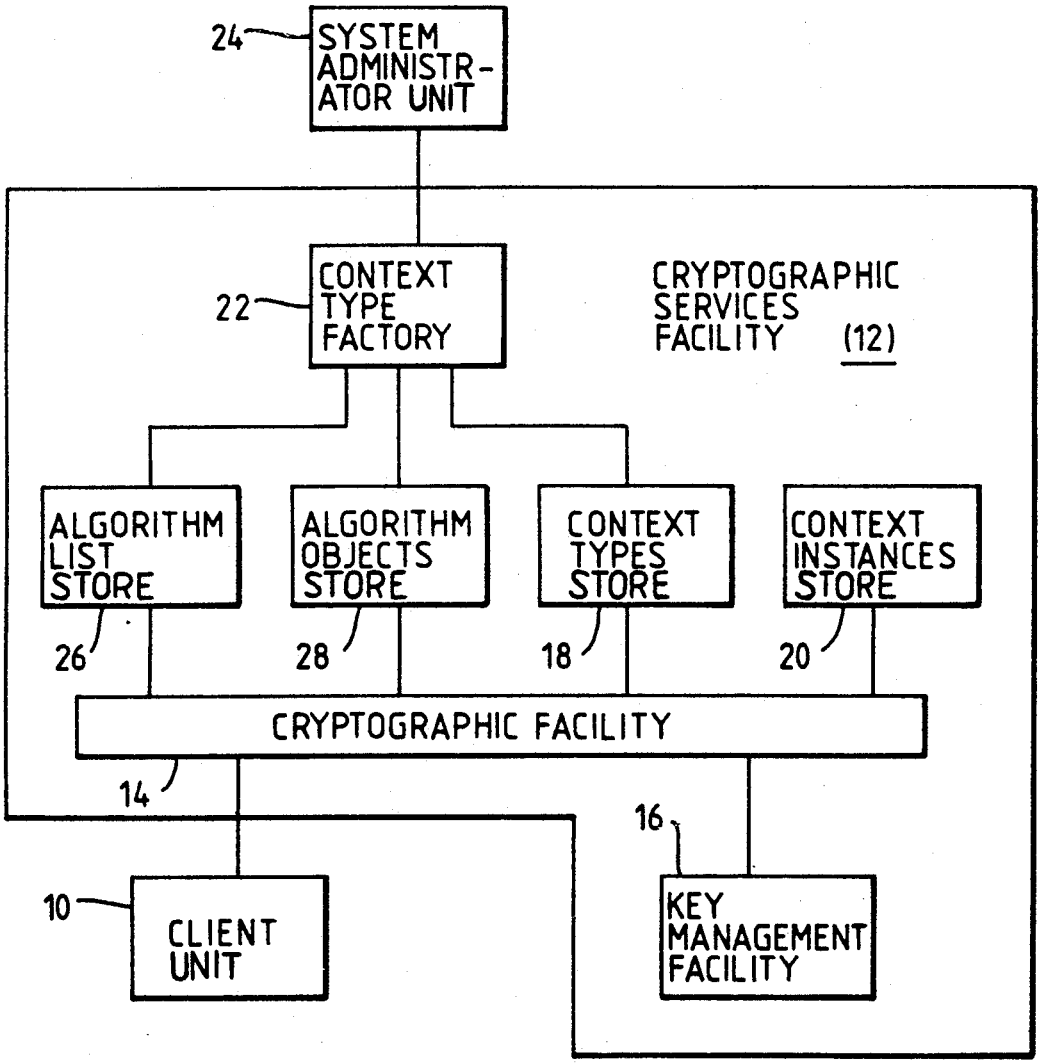
FIG. 1 is an elevational front view showing the configuration of a conventional color video printer.
Figure 2:
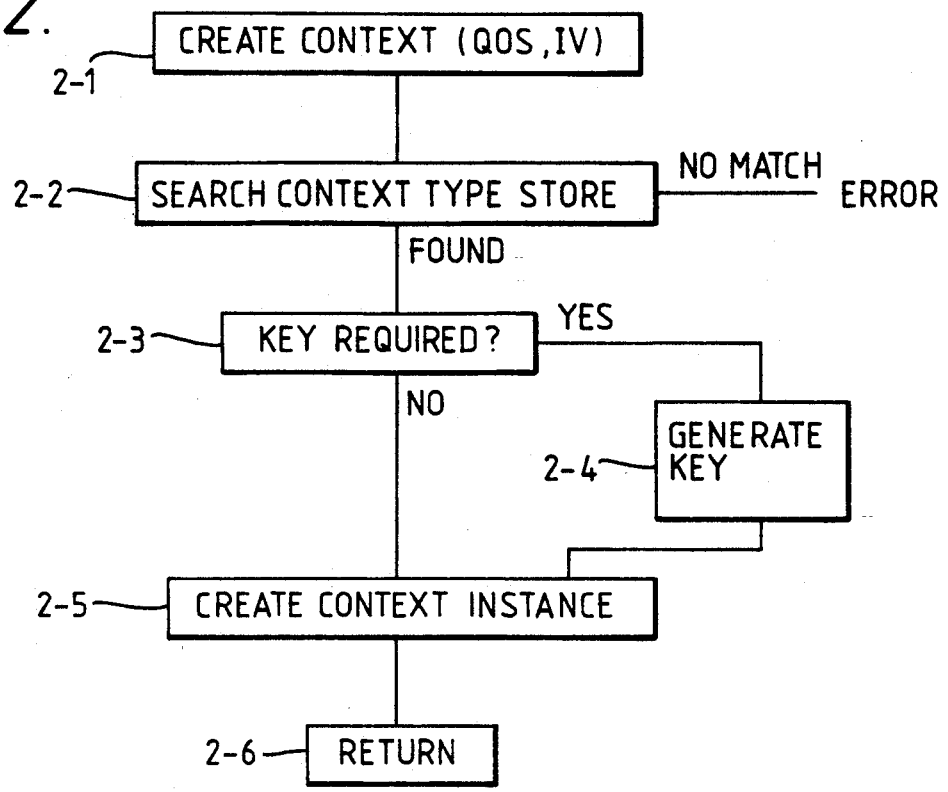
FIG. 2 is a detailed view of the portion "A" of FIG. 1.
Figure 3:
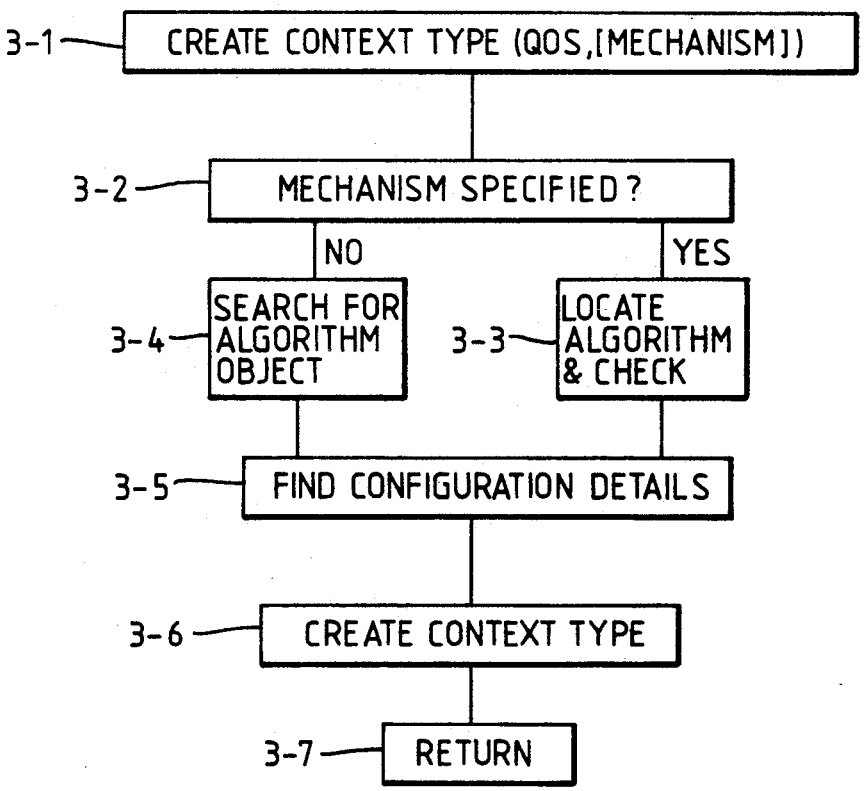
FIG. 3 is a front elevational view showing the conventional discharge roller and take-out roller.
Figure 4A:
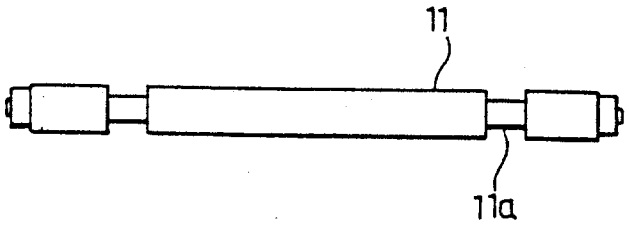
Figure 4B:
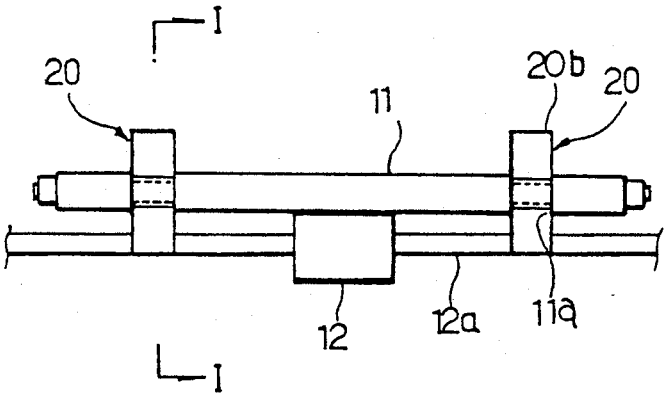
Figure 4C:
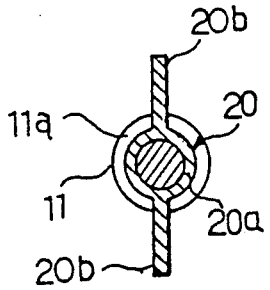

Referring now in detail to the drawings for the purpose of illustrating preferred embodiments of the present invention, the apparatus for discharging a printing paper for use in a color video printer as shown in FIGS. 4A to 4C, comprises a discharge roller 12, a take-out roller 11 which is engaged with the discharge roller 12 and is formed with fixing grooves 11*a* at its ends, and guide members 20 fixed to the fixing grooves 11*a* of the take-out roller 11.

The guide member 20 is made in a mould by an elastic material such as a rubber, a flexible synthetic resin or the like, and includes a tubular fixture 20*a* to be inserted into an fixed on the fixing groove 11*a* and one or more elastic blade 20*b* formed integrally therewith. It is preferable that the elastic blade 20*b* has a length enough to reach the rim portion 13*a* of the paper box 13.

In addition, it is also preferable that the tubular fixture 20*a* of the guide member 20 has a diameter smaller than that of the take-out roller 11 so that when the elastic blade 20*b* is wrapped around the tubular fixture 20*a* on account of the printing paper 15 being engaged between the take-out roller 11 and the discharge roller 12, the elastic blade 20*b* is positioned within the fixing groove 11*a* of the take-out roller 11, and thus does not protrude outwardly.

Figure 5:
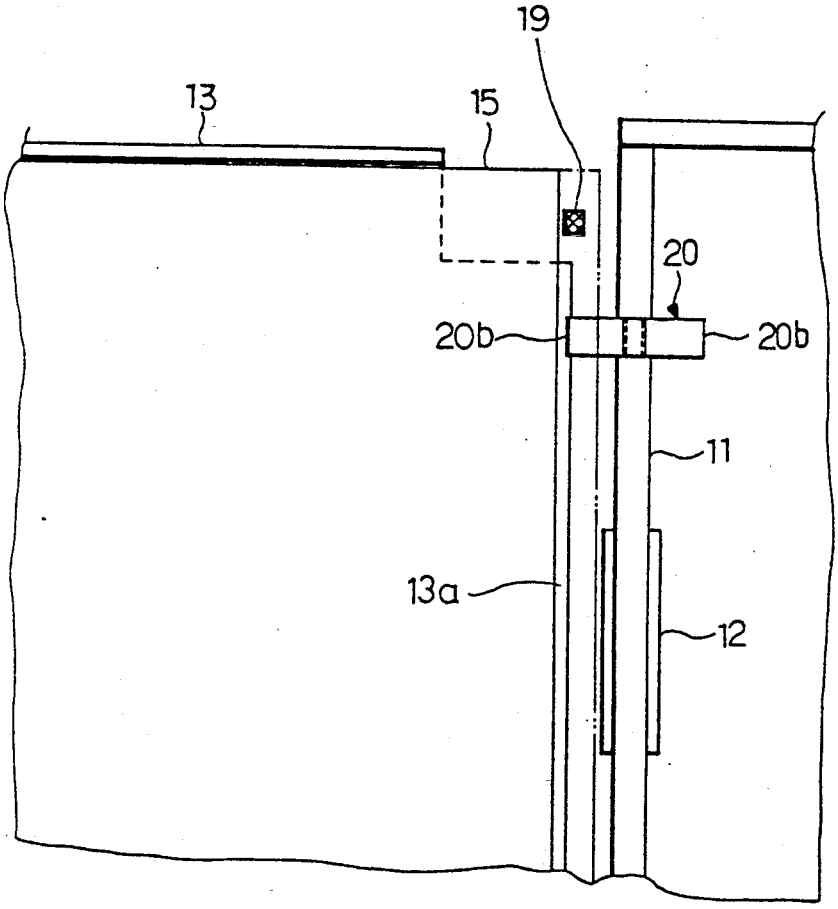
FIG. 5 is a plane view showing the paper discharge portion according to the present invention.

Referring to FIG. 5, there is shown a paper discharge portion in which a position sensor 19 for detecting the position of a printing paper is disposed on a corner edge of the paper box 13. As shown in FIG. 5, in a state that the printing paper 15 has not completely been inserted into the paper box 13, that is, in a state that the trailing edge of the printing paper 15 is laid on the rim portion 13*a* of the paper box 13, as shown in dotted line in FIG. 5, the driving force is continuously applied to the discharge roller 12 so that the take-out roller 11 which is in engagement with the discharge roller 12 rotates continuously, thereby the elastic blades 20*b* push the trailing edge of the printing paper 15 into the paper box 13.

Figure 6A:
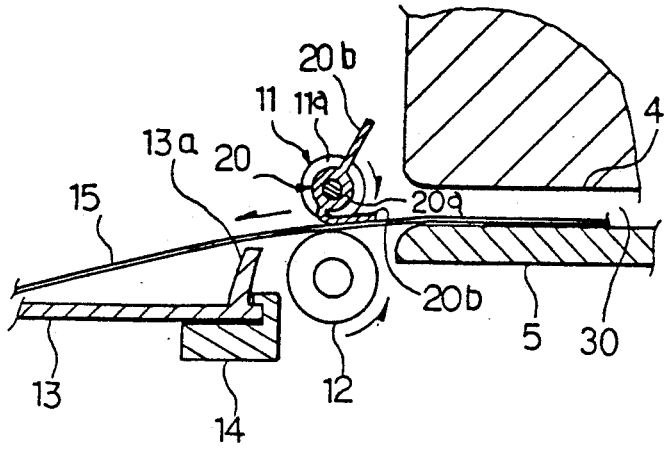
Figure 6B:
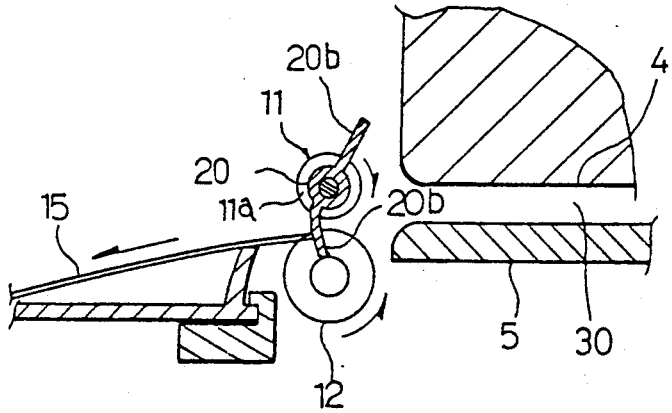
Figure 6C:
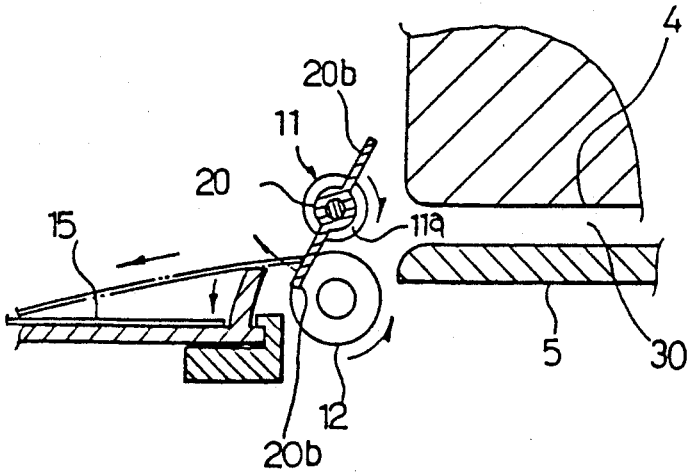

The apparatus for discharging printing paper of the present invention operates is as follows:

As shown in FIGS. 6A to 6C, the printing paper 15 which is transferred along the paper passage 30 formed between the upper and lower guides 4 and 5, is engaged between the discharge roller 12 and the take-out roller 11 and discharged in the direction indicated by arrows X. That is, when the printing paper 15 is located between the take-out roller 11 and the discharge roller 12, the guide members 20 are rotated together with the take-out roller 11 and the elastic blades 20*b* are wrapped and extended repeatedly. When the printing paper 15 is taken out from the discharge roller 11 and the take-out roller 12 as shown in FIG. 6B, the elastic blades 20*b* of the guide member 20 are extended by their original elasticity and push instantly the trailing edge of the printing paper 15 so that the printing paper 15 is completely inserted into the paper box 13, as indicated in solid line in FIG. 6C.

When the printing paper 15 is completely inserted into the paper box 13 as described above, the position sensor 19 detected the condition and stops the rotation of the discharge roller 12 and the take-out roller 11.

As described above in detail, the present invention provides the effect that it is possible to completely discharge the printing paper into a paper box by providing elastic guide members at the take-out roller, thereby preventing the picture image printed on the printing paper from being discharged.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An apparatus for discharging a printing paper for use in a color video printer, comprising:

a paper passage defined by an upper guide and a lower guide;

a discharge roller provided at an outlet of said paper passage;

a paper box for receiving a printing paper;

a take-out roller for discharging the printing paper into the paper box by engaging with said discharge roller, said take-out roller being mounted above said discharge roller; and at least one elastic guide member mounted on said take-out roller for pressing and feeding the printing paper and then for pushing the printing paper by an elastic force of said guide member into the paper box.

2. The apparatus of claim 1, wherein said take-out roller has a fixing groove and said guide member includes a tubular fixture fixed at the fixing groove, and at least one elastic blade integrally formed with said tubular fixture.

3. The apparatus of claim 2, wherein the paper box has a rim portion and wherein said elastic blade has a length enough to reach the rim portion of the paper box so that the elastic blade pushes an edge of the printing paper, thereby completely inserting the printing paper into the paper box.

4. The apparatus of claim 2, wherein the diameter of said tubular fixture around the elastic blade is wound is less than or the same as the diameter of the take-out roller.

5. The apparatus of claim 3, wherein the at least one elastic blade is engagable with a top surface of the printing paper and a rear edge of the printing paper as the printing paper is fed between the discharge roller and take-out roller into the paper box and wherein the at least one elastic blade has a generally straight, unbent shape when disengaged from the printing paper.

6. The apparatus of claim 5, wherein the at least one elastic blade comprises two diametrically opposed elastic blades on each of the at least one elastic guide members.

7. The apparatus of claim 6, wherein the at least one elastic guide member comprises two elastic guide members mounted on the take-out roller, each of the elastic guide members having the two diametrically opposed elastic blades.

8. The apparatus of claim 7, wherein the take-out roller is positioned between the two elastic guide members such that the elastic blades of both guide members fail to engage the take-out roller.

9. The apparatus of claim 1, wherein the at least one elastic guide member includes a tubular fixture and only two elastic blades integrally formed with the tubular fixture, the elastic blades being diametrically opposed to one another and being generally straight when disengaged form the printing paper.

10. The apparatus of claim 9, wherein two elastic guide members are provided as the at least one elastic guide member, each of the two elastic guide members having the tubular fixture and the two elastic blades, the take-out roller being positioned between the two elastic guide members.

* * * * *